United States Patent [19]

Blanchard

[11] 4,382,797

[45] May 10, 1983

[54] TRANSOM MOUNTED MARINE PROPULSION DEVICE WITH LATERAL CRANKSHAFT AND POWER SHAFT

[75] Inventor: Clarence E. Blanchard, Kenosha, Wis.

[73] Assignee: Outboard Marine Corporation, Waukegan, Ill.

[21] Appl. No.: 247,995

[22] Filed: Mar. 26, 1981

Related U.S. Application Data

[63] Continuation-in-part of Ser. No. 188,323, Sep. 18, 1980, Pat. No. 4,371,348.

[51] Int. Cl.[3] ..... B63H 5/12

[52] U.S. Cl. ..... 440/53; 440/75

[58] Field of Search ..... 440/75, 53, 58–63, 440/76–79

[56] References Cited

U.S. PATENT DOCUMENTS 2,691,954 10/1954 Shively ..... 440/75

3,826,219 7/1974 Nossiter ..... 440/75

FOREIGN PATENT DOCUMENTS 2224626 12/1972 Fed. Rep. of Germany ..... 440/61

*Primary Examiner*—Sherman D. Basinger

*Attorney, Agent, or Firm*—Michael, Best & Friedrich

[57] ABSTRACT

Disclosed herein is a marine propulsion device comprising a power head adapted for mounting to a boat transom and including an engine having a crankshaft extending horizontally and parallel to the transom when the engine is boat mounted, a cross shaft mounted in parallel relation to the crankshaft and behind the transom when the engine is boat mounted, a pulley and belt drive operably connected between the crankshaft and the cross shaft for rotating the cross shaft in response to rotation of the crankshaft, a lower unit including an upper housing section mounted to the power head for tilting movement relative thereto about the axis of the cross shaft, a drive shaft extending in the upper housing section in perpendicular relation to the cross shaft, a reversing transmission operably connected between the cross shaft and the drive shaft, and a propeller mounted on the lower unit and drivingly connected to the drive shaft.

6 Claims, 2 Drawing Figures

TRANSOM MOUNTED MARINE PROPULSION DEVICE WITH LATERAL CRANKSHAFT AND POWER SHAFT

RELATED APPLICATIONS

This application is a continuation-in-part of my earlier application, Ser. No. 188,323, filed Sept. 18, 1980, now U.S. Pat. No. 4,371,348, and entitled: MOUNTING FOR MARINE PROPULSION DEVICE LOCATED AFT OF BOAT TRANSOM, and incorporated herein by reference.

Reference is hereby also made to my co-pending application entitled "TRANSOM MOUNTED MARINE PROPULSION DEVICE WITH FORE AND AFT CRANKSHAFT AND POWER SHAFT", Ser. No. 247,915, filed Mar. 26, 1981, and to my co-pending application entitled "TRANSOM MOUNTED MARINE PROPULSION DEVICE WITH VERTICAL CRANKSHAFT AND TILTABLE LOWER UNIT AND RUDDER", Ser. No. 247,792, filed Mar. 26, 1981.

BACKGROUND OF THE INVENTION

The invention relates generally to marine propulsion devices and more particularly to marine propulsion devices including lower units which are swingable between a lowered running position and a raised position wherein the lower unit neither engages the boat transom nor passes forwardly over the top of the boat transom when in the fully raised position.

Attention is directed to the following U.S. Pat. Nos.:

Johnson 1,824,213 Sept. 22, 1931
Williams 2,091,247 Aug. 24, 1937
Soldner 2,386,362 Oct. 9, 1945
Shively 2,691,954 Oct. 19, 1954
Patty, Jr. 2,936,730 May 17, 1960
Liepert 2,946,306 July 26, 1960
Liepert 2,957,441 Oct. 25, 1960
Johnson 2,999,476 Sept. 12, 1961
Liepert 3,083,678 Apr. 2, 1963
Cameron 3,128,742 Apr. 14, 1964
Langley 3,589,204 June 29, 1971
Nossiter 3,826,219 July 30, 1974
Schimanckas 3,847,108 Nov. 12, 1974

None of the patents identified above discloses an engine mounted fixedly aft of the transom and including a horizontally extending crankshaft which is drivingly connected to a parallel horizontal cross shaft by a timing belt.

SUMMARY OF THE INVENTION

The invention provides a marine propulsion device comprising a power head adapted for mounting to a boat transom and including an engine having a crankshaft extending horizontally and parallel to the transom when the engine is boat mounted, a cross shaft mounted in parallel relation to the crankshaft and behind the transom when the engine is boat mounted, means operably connected between the crankshaft and the cross shaft for rotating the cross shaft in response to rotation of the crankshaft, a lower unit including an upper housing section mounted to the power head for tilting movement relative thereto about the axis of the cross shaft, a drive shaft extending in the upper housing section in perpendicular relation to the cross shaft, a reversing transmission operably connected between the cross shaft and the drive shaft, and a propeller mounted on the lower unit and drivingly connected to the drive shaft.

In one embodiment in accordance with the invention, the first mentioned lower unit is located laterally to one side of the power head and the marine propulsion device further includes a second lower unit located laterally to the other side of the power head.

In one embodiment in accordance with the invention, the second lower unit includes a second upper housing section mounted on the power head for tilting movement relative thereto about the axis of the cross shaft, a second drive shaft extending in the second upper housing section in perpendicular relation to the cross shaft, a second reversing transmission operably connected between the cross shaft and the second drive shaft, and a second propeller mounted on the second lower unit and drivingly connected to the second drive shaft.

Other features and advantages of the embodiments of the invention will become known by reference to the following general description, claims and appended drawings.

IN THE DRAWINGS

Figure 1:
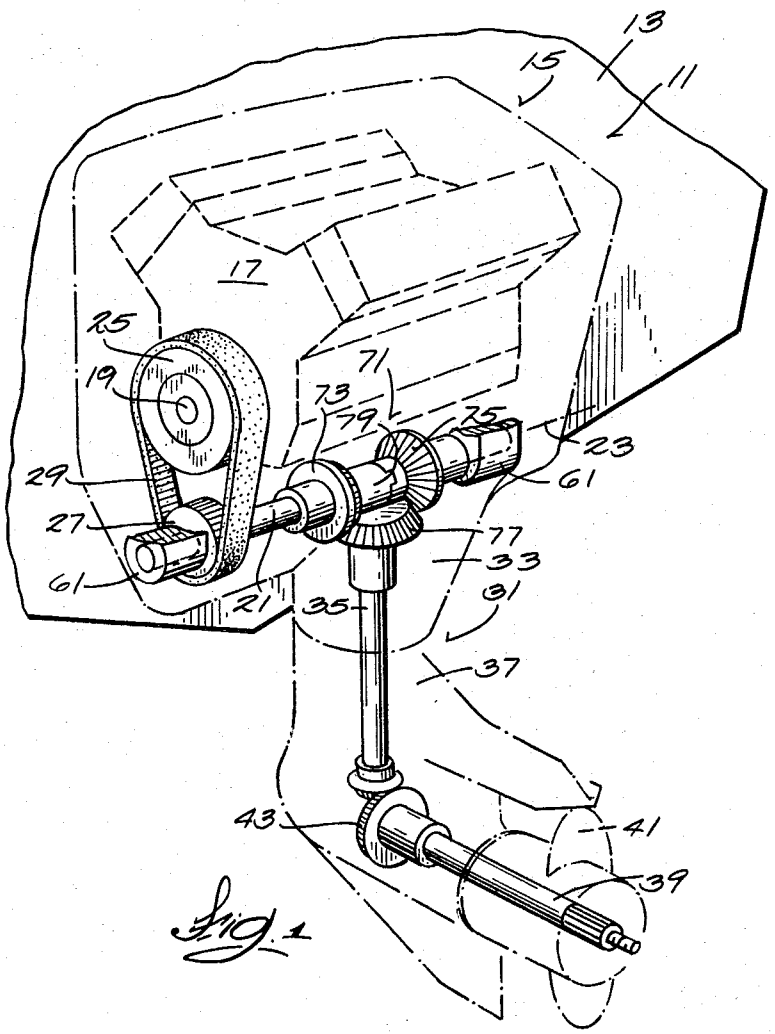
FIG. 1 is a schematic perspective view of one embodiment of a marine propulsion device embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a marine propulsion device 11 which is adapted to be fixedly mounted to the rear of a boat transom 13 and which includes a power head 15 including an internal combustion engine 17 having a crankshaft 19 which extends horizontally and in parallel relation to the boat transom 13 when the power head 15 is boat mounted.

Any suitable means (not shown) can be employed to fixedly mount the power head 15 to the rear of the boat transom 13. In addition, any suitable internal combustion engine 17 can be employed, including, for instance, multi-cylinder in-line and multi-cylinder V-block engines which can be either of two-stroke or four-stroke design.

Suitably supported by the power head 15 in parallel relation to the crankshaft 19 is a power takeoff or cross shaft 21 having an axis 23. Operatively connected between the crankshaft 19 and the cross shaft 21 is means for rotating the cross shaft 21 in response to rotation of the crankshaft 19. While various arrangements can be employed, in the illustrated construction, such means comprises a timing wheel or pulley 25 mounted on the crankshaft 19, a timing wheel or pulley 27 mounted on the cross shaft 21, and a endless timing belt 29 trained around the timing pulleys 25 and 27. As shown, the timing belt 29 preferably drives the cross shaft 21 at a rate of rotation greater than the rate of rotation of the crankshaft 19. If desired, a chain drive or a gear train could also be employed.

Mounted to the power head 15 is a lower unit 31 which includes an upper housing section 33 rotatably supporting a drive shaft 35 extending perpendicularly to the cross shaft 21. The drive shaft 35 extends into a lower housing section 37 which is supported from the upper housing section 33, and which rotatably supports a propeller shaft 39 carrying a propeller 41. Suitable gearing 43 can be employed to drivingly connect the drive shaft 35 and the propeller shaft 39. If desired, the upper housing section 33 can be mounted to the power head 15 for vertical swinging movement about a horizontal axis coincident with the axis 23 of the cross shaft 21.

If desired, the lower housing section 37 can be mounted for rotation relative to the upper housing section 33 about the drive shaft axis. Any suitable means can be employed to afford and control such rotation. If desired, a rudder could be employed in lieu of mounting of the lower housing section 37 for rotation relative to the upper housing section 33.

Any suitable mounting means can be employed. In the disclosed construction, such means comprises a pair of ears or lugs 61 which depend downwardly from the power head 15, which are laterally spaced apart, and which, in addition to rotatably supporting the cross shaft 21, also provide bearing means for supporting the upper housing section for tilting movement about the horizontal axis 23.

Operably connected between the cross shaft 21 and the drive shaft 35 is a reversing transmission 71 which is located in the upper housing section 33 and which includes a pair of spaced and facing bevel gears 73 and 75 which are mounted for rotation co-axially with and relative to the cross-shaft 21 and which are engaged with a bevel gear 77 fixed to the top of the drive shaft 35. Also included in the reversing transmission 71 is a dog 79 which is fixed to the cross shaft 21 for common rotation therewith, which includes lug means (not shown) engageable with cooperating lug means (not shown) on the bevel gears 73 and 75 so as selectively to enable driving engagement of the bevel gears 73 and 75 by the dog 79, and which is movable axially on the cross shaft 21 between a neutral position with the dog 79 out of engagement with both bevel gears 73 and 75, a first drive position with the dog 79 drivingly engaged with the bevel gear 73 to effect common rotation of the bevel gear 73 with the dog 79 and therefore with the cross shaft 21, and a second drive position with the dog 79 drivingly engaged with the other bevel gear 75 to effect common rotation of the bevel gear 75 with the dog 79 and therefore with the cross shaft 21.

Any suitable means (not shown) can be employed to axially shift the dog 79 between the neutral and drive positions.

Figure 2:
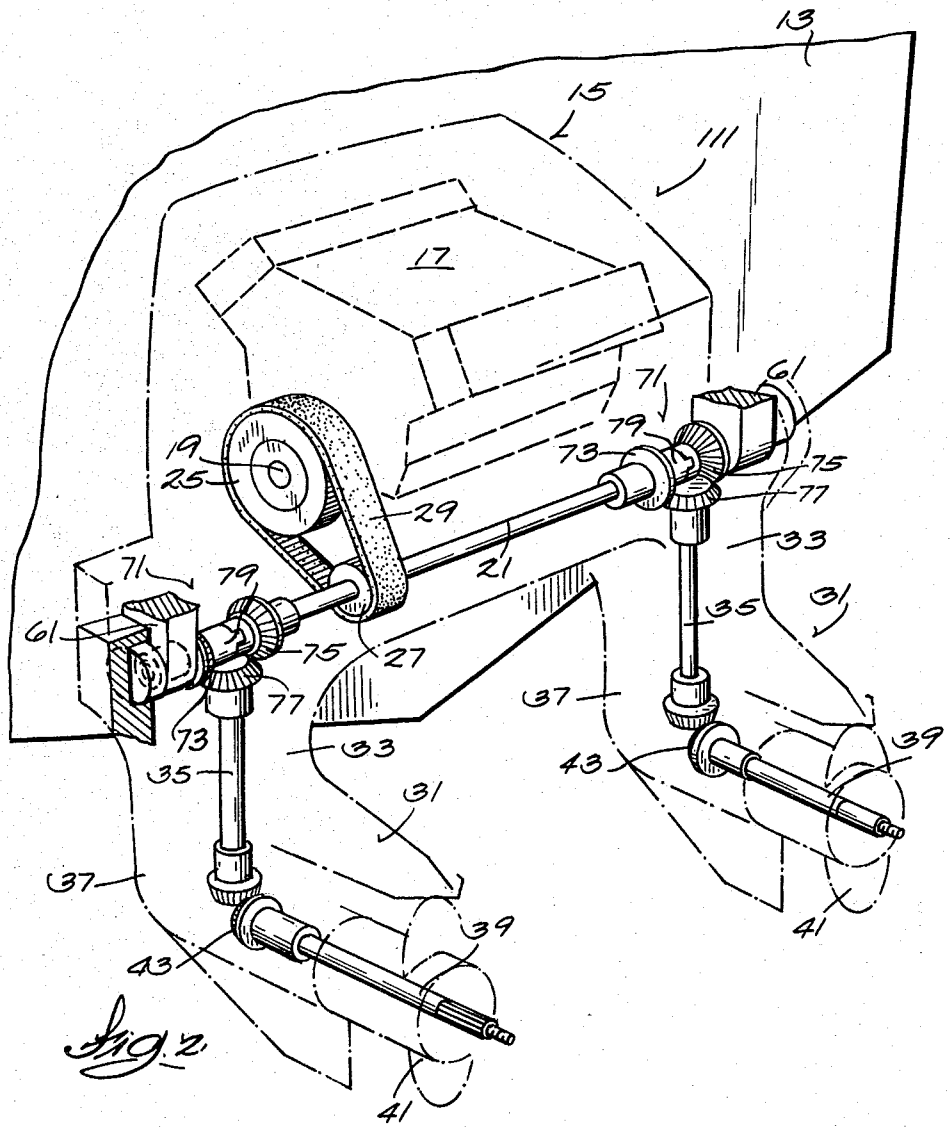
FIG. 2 is a schematic perspective view of another embodiment of a marine propulsion device embodying various of the features of the invention.

Shown in FIG. 2 is another embodiment of a marine propulsion device 111 which is generally identical to the construction shown in FIG. 1, except that two lower units 31 are employed, one to either side of the powerhead 15.

Accordingly, the same reference numerals have been applied to the components in the FIG. 2 construction as have been applied to the corresponding components of the FIG. 1 construction and no additional description will be provided.

More particularly, with respect to the differences between the marine propulsion device 111 of the FIG. 2 and the marine propulsion device 11 of FIG. 1, both of lower units 31 are, except for being mounted to opposite sides of the power head 15, of generally identical construction.

Any suitable bearing means can be employing to support the lower units 31 in cantilever fashion from the opposite sides of the power head 15. As already indicated, in other respects the construction shown in FIGS. 1 and 2 are identical.

The constructions shown in FIGS. 1 and 2 can be applied to the rear of a boat transom 13 and provide for upward trimming and tilting of the lower units 31 and for steering of the lower units 31 relative to the boat transom 13 without any intereference between the lower units 31 and rear of the boat transom 13 and without any travel of the lower units forwardly of the transom 13. Thus, the disclosed constructions are particularly adapted for use with boats having high transoms.

Various of the features of the invention are set forth in the following claims.

I claim:

1. A marine propulsion device comprising a power head adapted for mounting to a boat transom and including an engine having a crankshaft extending horizontally and parallel to the transom when said engine is boat mounted, a cross shaft mounted in parallel relation to said crankshaft and behind the transom when said engine is boat mounted, means operably connected between said crankshaft and said cross shaft for rotating said cross shaft in response to rotation of said crankshaft, a lower unit including an upper housing section mounted to said power head for tilting movement relative thereto soley about the axis of said cross shaft during normal operation of said marine propulsion device, a drive shaft extending in said upper housing section in perpendicular relation to said cross shaft, a reversing transmission operably connected between said cross shaft and said drive shaft, and a propeller mounted on said lower unit and drivingly connected to said drive shaft.

2. A marine propulsion device in accordance with claim 1 wherein said first mentioned lower unit is located laterally to one side of said power head and further including a second lower unit located laterally to the other side of said power head.

3. A marine propulsion device in accordance with claim 2 wherein said second lower unit includes a second upper housing section mounted on said power head for tilting movement relative thereto about the axis of said cross shaft, a second drive shaft extending in said second upper housing section in perpendicular relation to said cross shaft, a second reversing transmission operably connected between said cross shaft and said second drive shaft, and a second propeller mounted on said second lower unit and drivingly connected to said second drive shaft.

4. A marine installation comprising a boat hull having a transom and a marine propulsion device including a power head mounted on said boat transom and including an engine having a crankshaft extending horizontally and parallel to said transom when said engine is boat mounted, a cross shaft mounted in parallel relation to said crankshaft and behind said transom when said engine is boat mounted, means operably connected between said crankshaft and said cross shaft for rotating said cross shaft in response to rotation of said crankshaft, a lower unit including an upper housing section mounted to said power head for tilting movement relative thereto soley about the axis of said cross shaft during normal operation of said marine propulsion device, a drive shaft extending in said upper housing section in perpendicular relation to said cross shaft, a reversing transmission operably connected between said cross shaft and said drive shaft, and a propeller mounted on said lower unit and drivingly connected to said drive shaft.

5. A marine propulsion installation in accordance with claim 4 wherein said first mentioned lower unit is located laterally to one side of said power head and further including a second lower unit located lateraly to the other side of said power head.

6. A marine propulsion installation in accordance with claim 5 wherein said second lower unit includes a second upper housing section mounted on said power head for tilting movement relative thereto about the axis of said cross shaft, a second drive shaft extending in said second upper housing section in perpendicular relation to said cross shaft, a second reversing transmission operably connected between said cross shaft and said second drive shaft, and a second propeller mounted on said second lower unit and drivingly connected to said second drive shaft.

* * * * *